US008668327B2

(12) United States Patent
Makimoto et al.

(10) Patent No.: US 8,668,327 B2
(45) Date of Patent: Mar. 11, 2014

(54) PARTICLE DISPERSION SUPPLY APPARATUS AND IMAGE FORMING DEVICE

(75) Inventors: Akihiro Makimoto, Kanagawa (JP); Akihiro Hashiguchi, Kanagawa (JP); Kiyoshi Irita, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 262 days.

(21) Appl. No.: 13/346,742

(22) Filed: Jan. 10, 2012

(65) Prior Publication Data

US 2012/0210892 A1 Aug. 23, 2012

(30) Foreign Application Priority Data

Feb. 21, 2011 (JP) ..... 2011-034934

(51) Int. Cl.
*B41J 2/01* (2006.01)

(52) U.S. Cl.
USPC ..... 347/103

(58) Field of Classification Search
USPC ..... 347/16, 17, 21, 101–106; 399/238, 239
See application file for complete search history.

(56) References Cited

U.S. PATENT DOCUMENTS 4,985,732 A * 1/1991 Landa et al. ..... 399/238
7,929,897 B2 * 4/2011 Sugimoto et al. ..... 399/353
8,042,906 B2 * 10/2011 Chiwata et al. ..... 347/21

FOREIGN PATENT DOCUMENTS

JP 8-267714 A 10/1996

* cited by examiner

*Primary Examiner* — Anh T. N. Vo
(74) *Attorney, Agent, or Firm* — SOLARIS Intellectual Property Group, PLLC

(57) ABSTRACT

A particle dispersion supply apparatus includes a roller, an ejection device and a particle dispersion permeation member. The roller rotates in a prescribed direction and touches an image formation face of a recording medium being conveyed by a conveyance body. The ejection device is disposed to oppose the roller at a roller rotation direction upstream side relative to the position at which the roller touches the image formation face of the recording medium, and ejects a particle dispersion in which numerous particles are dispersed in a liquid. The particle dispersion permeation member is disposed so as to be interposed between the ejection device and the roller and so as to contact the roller. The particle dispersion permeation member retains the particle dispersion and the particle dispersion can permeate therethrough.

11 Claims, 3 Drawing Sheets

PARTICLE DISPERSION SUPPLY APPARATUS AND IMAGE FORMING DEVICE

CROSS-REFERENCE TO RELATED APPLICATION

This application claims priority under 35 USC 119 from Japanese Patent Application No. 2011-034934 filed Feb. 21, 2011, the disclosure of which is incorporated by reference herein.

BACKGROUND

1. Technical Field

The present invention relates to a particle dispersion supply apparatus and an image forming device.

2. Related Art

Heretofore, an image forming device has been known that ejects ink droplets from an inkjet recording head at a recording medium such as paper or the like.

In this image forming device, ink droplets are ejected at the recording medium, the ink droplets on the recording medium are dried by heating and fixed, and then the recording mediums are successively discharged to and stacked on a discharge section. In this image forming device, when the recording mediums are stacked on the discharge section, a phenomenon known as blocking (hereinafter referred to as stacker blocking) may occur, in which ink adheres between the recording mediums laid on top of one another. In particular, in a high-productivity inkjet recording device, insufficient drying or insufficient fixing of the ink tends to occur, so stacker blocking tends to occur.

Japanese Patent Application Laid-Open (JP-A) No. 8-267714 discloses a powder supply apparatus that electrically charges an insulative film, then causes controlled amounts of a powder to be attracted to the insulative film, touches the insulative film against an ink surface of a recording paper that has just been printed on, and causes the powder to selectively adhere only to undried ink portions of the recording paper.

However, in JP-A No. 8-267714, the powder is simply attracted to the insulating film and is adhered only at the undried ink portions of the paper. Therefore, if the powder supply apparatus is installed in an image forming device in which there is a drying wind, the powder may be blown around.

SUMMARY

The present invention provides a particle dispersion supply apparatus that is capable of adhering particles to an image formation surface of a recording medium such that the particles do not fly around and of suppressing occurrences of stacker blocking, and an image forming device.

A particle dispersion supply apparatus of a first aspect of the present invention includes: a roller that rotates in a prescribed direction and touches an image formation face of a recording medium conveyed by a conveyance body; an ejection device that is disposed to oppose the roller at an upstream side of a rotation direction of the roller relative to a position at which the roller touches the image formation face of the recording medium, and that ejects a particle dispersion in which numerous particles are dispersed in a liquid; and a particle dispersion permeation member that is disposed so as to be interposed between the ejection device and the roller and so as to contact the roller, that retains the particle dispersion, and through which the particle dispersion is permeated.

According to the particle dispersion supply apparatus described above, the roller that touches the image formation face of the recording medium conveyed by the conveyance body is provided, the ejection device is disposed at the upstream side of the rotation direction of the roller relative to the position that touches against the image formation face of the recording medium, and the particle dispersion in which the numerous particles are dispersed in the liquid is ejected from the ejection device. The particle dispersion permeation member, which retains the particle dispersion and allows the particle dispersion to permeate therethrough, is interposed between the ejection device and the roller and contacts the roller. Thus, the particle dispersion ejected from the ejection device is retained in the particle dispersion permeation member and the particle dispersion is supplied to the roller by permeating through the particle dispersion permeation member. The particle dispersion supplied to the roller is coated onto the image formation face of the recording member by the roller rotating, and the numerous particles are adhered to the image formation face of the recording member as a result. Thus, the particles are adhered to the image formation face of the recording member without the particles flying around, and occurrences of stacker blocking may be suppressed.

Because the particle dispersion permeation member is disposed between the ejection device and the roller, occurrences of dripping when the particle dispersion is being ejected from the ejection device may be suppressed and the particle dispersion may be supplied to the roller consistently.

A particle dispersion supply apparatus of a second aspect of the invention is the particle dispersion supply apparatus of the first aspect of the invention, in which the ejection device ejects the particle dispersion from numerous holes formed in an ejection face.

According to the particle dispersion supply apparatus described above, because the particle dispersion is ejected from the numerous holes formed in the ejection face of the ejection device, variations of the particle dispersion within the ejection face may be suppressed.

A particle dispersion supply apparatus of a third aspect of the invention is the particle dispersion supply apparatus of the first aspect of the invention, in which a syringe is used for ejection driving of the ejection device.

According to the particle dispersion supply apparatus described above, the syringe is used for ejection driving of the ejection device and ejection amounts of the particle dispersion may be controlled at low cost.

A particle dispersion supply apparatus of a fourth aspect of the invention is the particle dispersion supply apparatus of the first aspect of the invention, in which, one of before ejection and after ejection of the particle dispersion by the ejection device, liquid that does not contain the particles is ejected at the particle dispersion permeation member from at least one of the ejection device or a cleaning ejection device.

According to the particle dispersion supply apparatus described above, the liquid not containing particles is ejected at the particle dispersion permeation member from the ejection device or the cleaning ejection device, either before or after ejection of the particle dispersion by the ejection device. Thus, clogging of particles in the ejection device and the particle dispersion permeation member may be suppressed and/or particles may be removed.

A particle dispersion supply apparatus of a fifth aspect of the invention is the particle dispersion supply apparatus of the first aspect of the invention, further including: a pair of roll members on which respective end portions of the particle dispersion permeation member are wound; a first support member that is disposed at a downstream side of the rotation direction of the roller relative to the ejection device and that supports the particle dispersion permeation member from a rear face side such that the particle dispersion permeation member contacts the roller; and a second support member that is disposed at the upstream side of the rotation direction of the roller relative to the ejection device, at a position not contacting the roller, and that supports the particle dispersion permeation member and applies tension to the particle dispersion permeation member.

According to the particle dispersion supply apparatus described above, the end portions of the particle dispersion permeation member are wound up on the pair of roll members, the particle dispersion permeation apparatus is supported from the rear face side thereof by the first support member disposed at the downstream side of the rotation direction of the roller relative to the ejection device such that the particle dispersion permeation member is contacted with the roller, and the particle dispersion permeation member is supported such that tension is applied thereto by the second support member that is disposed at the upstream side of the rotation direction of the roller relative to the ejection device and at a position that does not contact the roller. Therefore, the particle dispersion pools in a vicinity of the particle dispersion permeation member that is disposed between the ejection device and the roller at the upstream side of the rotation direction of the roller relative to the first support member, and the particle dispersion may be supplied to the roller more consistently. Because the second support member is disposed at the upstream side of the rotation direction of the roller relative to the ejection device and at a position not contacting the roller, the particle dispersion is inhibited from pooling at the upstream side of the rotation direction of the roller relative to the second support member, and occurrences of dripping may be suppressed.

A particle dispersion supply apparatus of a sixth aspect of the invention is the particle dispersion supply apparatus of the fifth aspect of the invention, further including a driving section that rotates the roll members to feed out the particle dispersion permeation member.

According to the particle dispersion supply apparatus described above, a contact surface between the particle dispersion permeation member and the roller is renewed by the roll members being rotated by the driving section and the particle dispersion permeation member being fed out. Therefore, clogging of particles and pooling of particles at the particle dispersion permeation member may be suppressed.

A particle dispersion supply apparatus of a seventh aspect of the invention is the particle dispersion supply apparatus of the first aspect of the invention, in which the liquid includes silicone oil and the particles include plastic particles with a particle diameter in a range from 10 to 50 μm.

According to the particle dispersion supply apparatus described above, glossiness of the image formation face of the recording medium may be assured by the silicone oil, and because the 10-50 μm plastic particles are adhered to the image formation face of the recording medium, occurrences of stacker blocking may be more effectively suppressed.

A particle dispersion supply apparatus of an eighth aspect of the invention is the particle dispersion supply apparatus of the first aspect of the invention, in which a void pore diameter of the particle dispersion permeation member is in a range from 1 to 10 times a particle diameter of the particles.

According to the particle dispersion supply apparatus described above, the void pore diameters of the particle dispersion permeation member are 1 to 10 times the particle diameter of the particles. Thus, the particles are inhibited from remaining in the particle dispersion permeation member, and the particle dispersion may be consistently supplied to the roller.

A particle dispersion supply apparatus of a ninth aspect of the invention is the particle dispersion supply apparatus of the first aspect of the invention, in which the roller includes a surface material with a surface energy of 40 mN/m or less.

According to the particle dispersion supply apparatus described above, because the surface material of the roller has a surface energy of not more than 40 mN/m, an efficiency of transfer of the particle dispersion from the roller to the image formation face of the recording member may be improved. In addition, excessive supply of the particle dispersion from the particle dispersion permeation member to the roller may be suppressed.

An image forming device of a tenth aspect of the invention includes: a droplet ejection apparatus that ejects droplets at a recording medium and forms an image; a conveyance body that conveys the recording medium; and the particle dispersion supply apparatus of the first aspect of the invention, wherein the roller is a heating roller that, after droplet ejection by the droplet ejection apparatus, heats the recording medium and fixes the droplets.

According to the image forming device described above, the particle dispersion is supplied to the heating roller that heats the recording medium and fixes the droplets after droplet ejection by the droplet ejection apparatus, and the particle dispersion is coated from the heating roller onto the image formation face of the recording medium. That is, because the heating roller provided in the image forming device is used, a number of components may be kept down and fixing performance of image portions of the recording medium may be maintained.

An image forming device of an eleventh aspect of the invention is the image forming device of the tenth aspect of the invention, in which the particle dispersion supply apparatus is disposed at a position just following a drying process that dries the recording medium after the droplet ejection by the droplet ejection apparatus.

According to the image forming device described above, the particle dispersion supply apparatus is disposed at the position just following the drying process that dries the recording medium after droplet ejection by the droplet ejection apparatus. Thus, the particles are well embedded into image portions of the recording medium.

BRIEF DESCRIPTION OF THE DRAWINGS

Exemplary embodiments of the present invention will be described in detail based on the following figures, wherein.

DETAILED DESCRIPTION

Herebelow, an exemplary embodiment relating to the present invention is described with reference to the attached drawings.

—Overall Structure—

Figure 1:
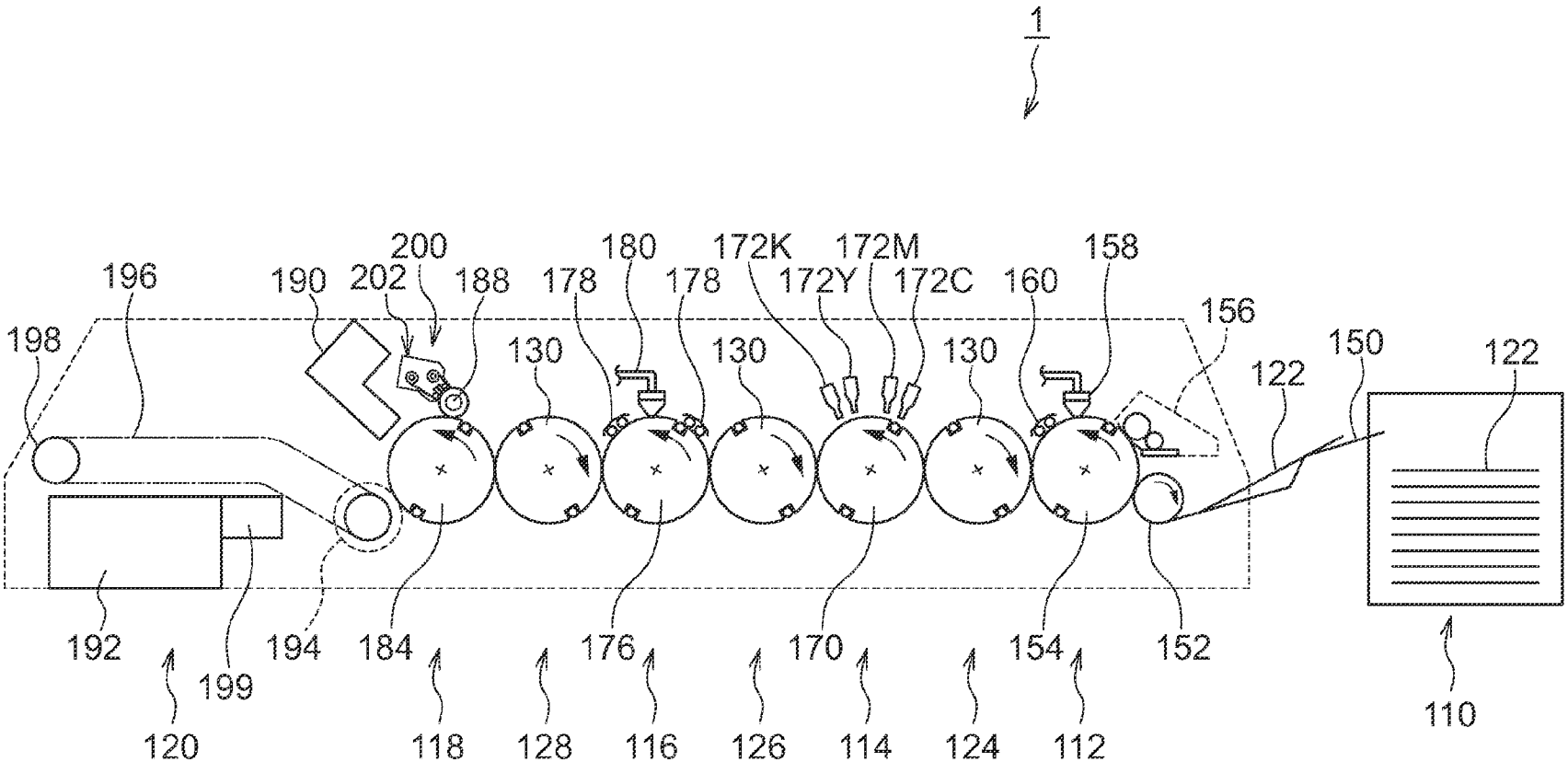
FIG. 1 is a schematic diagram illustrating overall structure of an image forming device in which a particle dispersion supply apparatus relating to an exemplary embodiment of the present invention is installed.

Below, an example of structure of an inkjet-type image forming device for embodying the particle dispersion supply apparatus of the present invention is described with reference to FIG. 1. FIG. 1 is a schematic diagram (side view) illustrating the overall image forming device.

An inkjet recording device 1 is an impression cylinder direct imaging-type inkjet recording device that ejects ink (droplets) of plural colors from inkjet heads 172C, 172M, 172Y and 172K, which serve as an example of a droplet ejection apparatus, and forms a desired color image on a paper 122 that is retained on an impression cylinder (an imaging drum 170) of an imaging section 114. The inkjet recording device 1 is an on-demand type image forming device employing a two-liquid reaction (coagulation) system in which a processing liquid (an ink coagulation processing liquid) is applied to the paper 122 before the ejection of the inks and the processing liquid reacts with the inks to form an image on the paper 122.

The inkjet recording device 1 is principally constituted with a paper supply section 110, a processing liquid application section 112, the imaging section 114, a drying section 116, a fixing section 118 and a discharge section 120.

The paper supply section 110 is a mechanism that supplies the paper 122 to the processing liquid application section 112. The paper 122, which is sheets of paper, is stacked in the paper supply section 110. A paper supply tray 150 is provided in the paper supply section 110, and the paper 122 is supplied from the paper supply tray 150 to the processing liquid application section 112 one sheet at a time. In the inkjet recording device 1, plural kinds of the paper 122 may be used, of different paper types, sizes (media sizes) and the like. In the present exemplary embodiment, the use of sheets of paper (cut paper) as the paper 122 is described.

The processing liquid application section 112 is a mechanism that applies the processing liquid to a recording face (an image formation face) of the paper 122. The processing liquid includes a colorant coagulant that causes colorants in the inks applied by the imaging section 114 to coagulate. Separation of each ink into a colorant and a solvent is promoted by the processing liquid and the ink coming into contact.

As illustrated in FIG. 1, the processing liquid application section 112 is provided with a paper supply cylinder 152, a processing liquid drum 154 and a processing liquid application apparatus 156. The processing liquid drum 154 is a drum that retains the paper 122 and rotates to convey the paper 122. The processing liquid drum 154 is provided with a pawl-form retainer (a gripper) at an outer periphery face thereof. A leading end of the paper 122 may be retained by the paper 122 being nipped between the pawl of the retainer and the periphery face of the processing liquid drum 154.

The processing liquid drum 154 may be provided with suction holes in the outer periphery face thereof and connected to a suction unit that applies suction through the suction holes. Thus, the paper 122 may be retained in area contact with the periphery face of the processing liquid drum 154.

The processing liquid application apparatus 156 is disposed at the outer side of the processing liquid drum 154, opposing the periphery face of the processing liquid drum 154. The processing liquid application apparatus 156 is structured by a processing liquid container in which the processing liquid is stored, an anilox roller of which a portion is immersed in the processing liquid in the processing liquid container, and a rubber roller that presses against the anilox roller and the paper 122 on the processing liquid drum 154 and transfers metered amounts of the processing liquid to the paper 122. According to this processing liquid application apparatus 156, the processing liquid may be metered while being applied to the paper 122. At a downstream side of the paper 122 conveyance direction relative to the processing liquid application apparatus 156, a hot air heater 158 and an infrared heater 160 are provided, which dry the processing liquid applied to the paper 122.

The paper 122 to which the processing liquid has been applied by the processing liquid application section 112 is handed over from the processing liquid drum 154 to the imaging drum 170 of the imaging section 114 via an intermediate conveyance section 124 (a handover cylinder 130). The imaging section 114 is provided with the imaging drum 170 and the inkjet heads 172C, 172M, 172Y and 172K. Similarly to the processing liquid drum 154, the imaging drum 170 is provided with a pawl-form retainer (gripper) at the outer periphery face thereof. The paper 122 that is fixed to the imaging drum 170 is conveyed with the recording face thereof facing outward, and the inks are applied to the recording face from the inkjet heads 172C, 172M, 172Y and 172K.

Each of the inkjet heads 172C, 172M, 172Y and 172K is a full-line inkjet-type recording head (inkjet head) with a length corresponding to the maximum width of an image forming region of the paper 122. Nozzle rows, in which plural nozzles for ink ejection are arrayed over the whole width of the ink ejection region, are formed in an ink ejection face of each of the inkjet heads 172C, 172M, 172Y and 172K. The inkjet heads 172C, 172M, 172Y and 172K are each arranged so as to extend in a direction orthogonal to the conveyance direction of the paper 122 (the rotation direction of the imaging drum 170).

Droplets of the inks of corresponding colors are ejected from the inkjet heads 172C, 172M, 172Y and 172K towards the recording face of the paper 122 that is retained in area contact with the imaging drum 170. Hence, the inks come into contact with the processing liquid previously applied to the recording face by the processing liquid application section 112, colorant or resin particles dispersed in the ink coagulate, and coagulations are formed. Thus, colorant flow or the like on the paper 122 is prevented, and an image is formed on the recording face of the paper 122.

The paper 122 on which the image has been formed by the imaging section 114 is handed over from the imaging drum 170 to a drying drum 176 of the drying section 116 via an intermediate conveyance section 126. The drying section 116 is a mechanism that dries out moisture contained in the solvent that has been separated by the coagulation action. As illustrated in FIG. 1, the drying drum 176 is provided with a plural number of infrared heaters 178 and a hot air heater 180 that is disposed between the infrared heaters 178.

Similarly to the processing liquid drum 154, the drying drum 176 is provided with a pawl-type retainer (gripper) at the outer periphery face thereof, and may retain the leading end of the paper 122 with this retainer. A temperature and wind amount of a hot wind blown from the hot air heater 180 toward the paper 122 and temperatures of the infrared heaters are detected by sensors and sent to an unillustrated control section as temperature data. The control section suitably adjusts the temperature and wind amount of the hot wind and the temperatures of the infrared heaters in accordance with the temperature data. Thus, a variety of drying conditions can be realized.

A surface temperature of the drying drum 176 may be set to 50° C. or more. Thus, drying is promoted by heating from the rear face of the paper 122 and damage to the image during fixing may be prevented. An upper limit of the surface temperature of the drying drum 176 is not particularly limited but is preferably set to 75° C. or less (and more preferably 60° C.

or less) with a view to safety in maintenance operations such as cleaning off ink that has adhered to the surface of the drying drum 176 (i.e., avoiding burn injuries that are caused by high temperatures).

The recording face of the paper 122 is retained so as to face outward at the outer periphery face of the drying drum 176 (that is, in a state of being curved such that the recording face of the paper 122 is at the convex side), and the drying drum 176 dries the recording face of the paper 122 while rotating for conveyance. Thus, the formation of wrinkles, lifting or the like on the paper 122 may be prevented, and unevenness in drying that results therefrom may be prevented.

The paper 122 that has been subjected to drying processing by the drying section 116 is handed over from the drying drum 176 to a fixing drum 184 of the fixing section 118 via an intermediate conveyance section 128. A hot air heater (not illustrated) that blows a hot wind at the recording face of the paper 122 may be provided in a handover cylinder 130 of the intermediate conveyance section 128. When a hot air heater is provided in the handover cylinder 130 of the intermediate conveyance section 128, the moisture contained in the solvent that has been separated by the coagulation action may be dried just after the inks have been ejected at the paper 122 by the inkjet heads 172C, 172M, 172Y and 172K.

The fixing section 118 is structured by the fixing drum 184, which serves as an example of a conveyance body that retains and conveys the paper 122, a fixing roller (heating roller) 188 that serves as an example of a roller, and an inline sensor 190.

Similarly to the processing liquid drum 154, the fixing drum 184 is provided with a pawl-type retainer (gripper) at the outer periphery face thereof, and may retain the leading end of the paper 122 with this retainer. The paper 122 is conveyed with the recording face facing outward by rotation of the fixing drum 184, fixing processing is carried out on the recording face by the fixing roller 188, and an inspection is conducted by the inline sensor 190.

The fixing roller 188 is a roller member for fusing resin particles in the ink (particularly self-dispersing polymer particles) and forming the ink into a skin by pressing and heating the ink, and is constituted so as to press and heat the paper 122.

Specifically, the fixing roller 188 is disposed so as to press against the fixing drum 184, and constitutes a nipping roller against the fixing drum 184. The fixing roller 188 is constituted to rotate passively with rotation of the fixing drum 184 at which the paper 122 is retained. Thus, the paper 122 is nipped between the fixing roller 188 and the fixing drum 184, being nipped with a predetermined nipping pressure (for example, 0.15 MPa), and is subjected to fixing processing.

The fixing roller 188 is constituted by a heating roller in which a halogen lamp is contained in a metal pipe with good thermal conductivity, of aluminium or the like, and is controlled to a predetermined temperature (for example, 60-80° C.).

Heat energy to at least the glass transition temperature (Tg) of resin particles contained in the ink is applied by the paper 122 being heated by the heating roller. Thus, the resin particles are fused and pressed into bumps and indentations in the paper 122 and fixing is implemented. In addition, bumps and indentations in the image surface are levelled and glossiness is provided.

A particle dispersion supply apparatus 200 is disposed at a position opposing the fixing drum 184. The particle dispersion supply apparatus 200 supplies a particle dispersion in which numerous particles (matting agent particles) are dispersed in a liquid. The particle dispersion supply apparatus 200 is provided with the fixing roller 188 and a supply unit 202. The fixing roller 188 serves as an example of a roller that touches against the recording face (image formation face) of the paper 122 being retained and conveyed on the fixing drum 184. The supply unit 202 is disposed at the fixing roller 188 rotation direction upstream side relative to the position at which the fixing roller 188 touches the paper 122, and supplies the particle dispersion to the fixing roller 188. In the particle dispersion supply apparatus 200, the particle dispersion from the supply unit 202 is supplied to the surface of the fixing roller 188, the fixing roller 188 rotates, and the particle dispersion is coated onto the recording face (image formation face) of the paper 122. The particle dispersion supply apparatus 200 is described below.

The inline sensor 190 is a measurement unit for measuring a check pattern, water amount, surface temperature, glossiness and the like of the image fixed to the paper 122. A CCD line sensor or the like is employed as the inline sensor 190.

According to the fixing section 118, the resin particles in the thin image layer formed by the drying section 116 may be fixed to the paper 122 by being pressed and heated by the fixing roller 188 and fused. Moreover, because the surface temperature of the fixing drum 184 is set to at least 50° C. and the paper 122 retained at the outer periphery face of the fixing drum 184 is heated from the rear face thereof, drying is promoted, damage to the image during fixing may be avoided, and image strength may be increased by an effect of raising the image temperature.

As illustrated in FIG. 1, the discharge section 120 is provided at the recording medium conveyance direction downstream side of the fixing section 118. The discharge section 120 is provided with a discharge tray 192. A handover cylinder 194, a conveyance belt 196 and a tension roller 198 are provided between the discharge tray 192 and the fixing drum 184 of the fixing section 118 so as to communicate therebetween. The paper 122 is transported to the conveyance belt 196 by the handover cylinder 194 and discharged to the discharge tray 192.

Although not illustrated in FIG. 1, the inkjet recording device 1 is provided with storage tanks that supply the inks to the respective inkjet heads 172C, 172M, 172Y and 172K and with means for supplying the processing fluid to the processing liquid application section 112. The inkjet recording device 1 is also provided with a head maintenance section that cleans the inkjet heads 172C, 172M, 172Y and 172K (wiping nozzle faces, purging, sucking out nozzles and the like), position detection sensors that sense positions of the paper 122 in the medium conveyance path, and temperature sensors that detect temperatures of respective portions of the device.

—Details of the Particle Dispersion Supply Apparatus 200—

Figure 2:
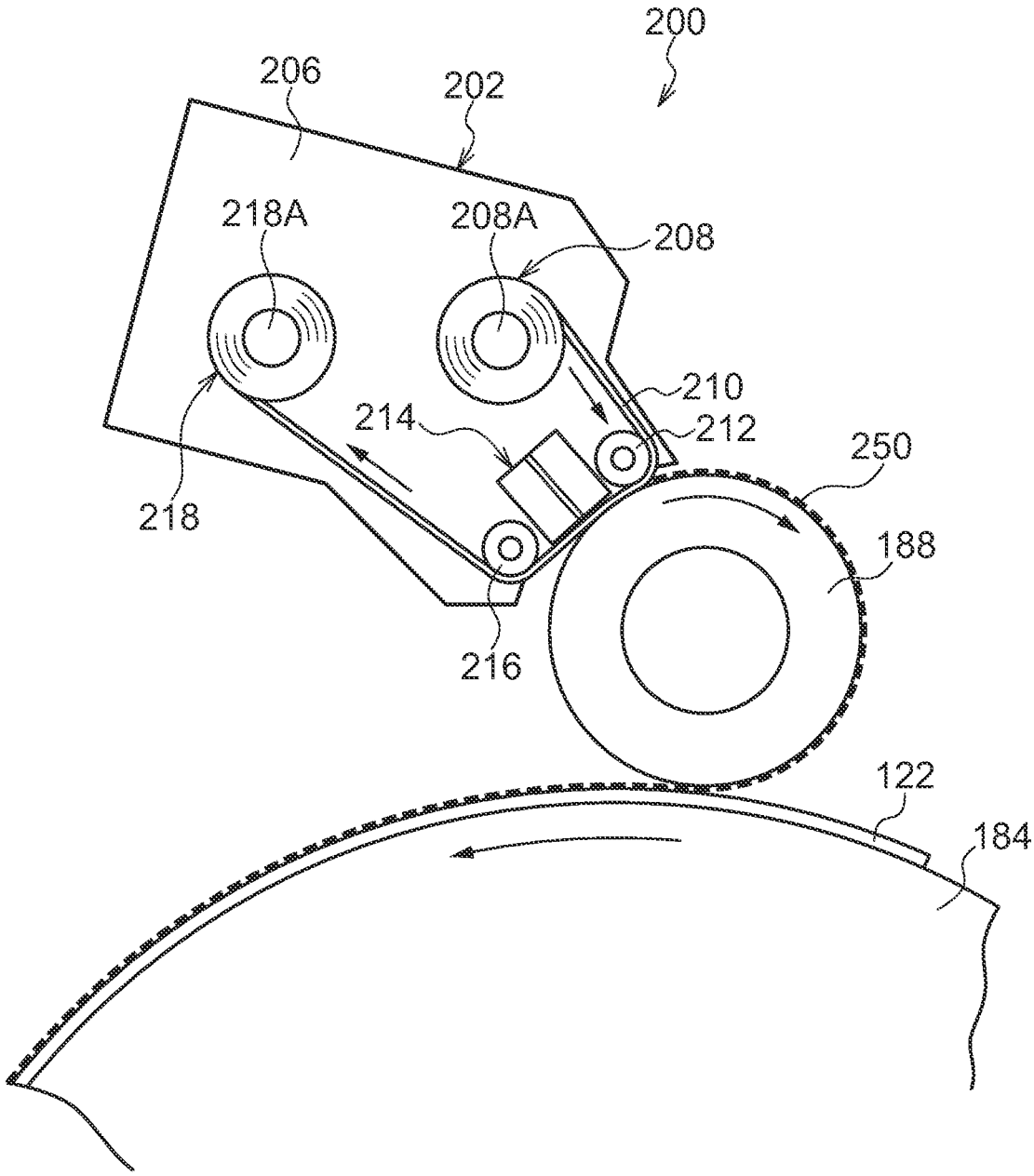
FIG. 2 is a structural diagram illustrating the particle dispersion supply apparatus relating to the exemplary embodiment of the present invention.

FIG. 2 shows details of the particle dispersion supply apparatus 200.

As described above, the particle dispersion supply apparatus 200 is provided with the fixing roller 188 that serves as the example of the roller, and the supply unit 202 that is disposed at the fixing roller 188 rotation direction upstream side relative to the position at which the fixing roller 188 touches the paper 122. The supply unit 202 is provided with a feedout roller (roll member) 208 that feeds out a belt-form web 210 in the direction of the arrows. The web 210 serves as an example of a particle dispersion permeation member.

The supply unit 202 is provided with, in order from the movement direction upstream side of the web 210 fed out from the feedout roller 208 to the movement direction downstream side, a first rod 212, an ejection head 214, a second rod 216 and a winding roller (roll member) 218. The first rod 212 serves as an example of a first support member that supports the web 210 from a rear face side such that the web 210 touches against the surface of the fixing roller 188. The ejection head 214 serves as an example of an ejection device that ejects the particle dispersion (the liquid in which the numerous particles are dispersed; reference numeral 250 in FIG. 2) from the rear face side of the web 210. The second rod 216 serves as an example of a second support member around which the rear face side of the web 210 is wound, for applying tension to the web 210. The winding roller 218 takes up the web 210.

The feedout roller 208, the first rod 212, the ejection head 214, the second rod 216, and the winding roller 218 are supported by side plates 206 of a casing of the supply unit 202. The winding roller 218 is provided with a winding core 218A round which the web 210 is wound. The web 210 is taken up onto the winding core 218A by the winding core 218A being driven to rotate. The feedout roller 208 is provided with a winding core 208A round which the web 210 is wound. The winding core 208A rotates in conjunction with the winding core 218A of the winding roller 218, and the web 210 moves in the direction of the arrows. In the present exemplary embodiment, the web 210 is moved by a predetermined amount each time a predetermined number of sheets of paper have passed, and the contact surface between the web 210 and the fixing roller 188 is renewed.

The web 210, in the state of being supported by the first rod 212 and the second rod 216, is interposed between the ejection head 214 and the fixing roller 188. The web 210 touches the surface of the fixing roller 188 at a position opposing an ejection face 230A of the ejection head 214 (see FIG. 3). In the present exemplary embodiment, the ejection face 230A of the ejection head 214 is disposed so as to touch against the rear face of the web 210.

The web 210 is constituted by a belt-form (long strip-form) member that is capable of retaining the particle dispersion (the liquid containing the numerous particles) and allowing the particle dispersion to permeate through. For example, a fabric material through which the particle dispersion, that is, the liquid, can be permeated together with the numerous particles is used as the web 210. As a fabric material, a nonwoven fabric, a woven fabric that is woven to enable permeation of the particles, or the like may be used. Besides fabric materials, porous resin sheets, paper materials and the like through which the particles can permeate may be used as the web 210.

As the particles (the matting agent particles) used in the particle dispersion (the liquid containing the numerous particles), for example, a plastic (for example, polymethyl methacrylate or polymethylene) or the like is preferable. As the liquid used in the particle dispersion, for example, a mold-releasing agent such as silicone oil or the like is preferable. It is preferable if diameters of the particles are 10 to 50 μm, and more preferable if they are 20 to 30 μm. If silicone oil is used as the liquid, when the liquid is coated onto the recording face (image formation face) of the paper 122, glossiness of the image may be assured, in addition to which offsetting of the image onto the fixing roller 188 may be suppressed. If the numerous particles are formed of a plastic, stacker blocking may be more effectively suppressed.

When the particle dispersion in which the numerous particles are dispersed is used, there is no activity of powdery particles (powder) in the inkjet recording device 1, in contrast with when powder particles are supplied directly to the fixing roller 188 and the recording face of the paper 122. Therefore, soiling inside the inkjet recording device 1 is reduced.

If a dispersion medium such as an oil, as the particle dispersion, is excessively applied to the recording face of the paper 122, uneven glossiness and/or uneven density (leading to repelling of the processing agent and/or the ink) becomes problematic. However, because the particle dispersion is supplied from the ejection head 214 to the fixing roller 188 via the web 210, the particle dispersion may be supplied to the fixing roller 188 in a state in which the particles are concentrated. Thus, dispersion medium amounts may be reduced compared to supply with another coating roller, a blade or the like. With a system in which the particle dispersion was directly coated, the liquid on the fixing roller 188 would be subject to repelling and uniform coating would be difficult. However, because the web 210 is interposed, dispersion medium amounts are reduced and, along with the effect of the particles being concentrated, the particle dispersion may be substantially uniformly coated onto the fixing roller 188.

Void pore diameters of the web 210 are preferably 1 to 10 times the diameters of the particles, and are more preferably 2 to 5 times the same. As a result, the particles may be inhibited from remaining in the web 210 and the particle dispersion may be supplied to the fixing roller 188 consistently. If the void pore diameters are smaller than 1 times the diameters of the particles, permeation of the particles is difficult, and if the void pore diameters are larger than 10 times the diameters of the particles, the web 210 may not retain suitable amounts of the particle dispersion and dripping may occur.

Because the particle dispersion is not directly coated onto the recording face of the paper 122 but coated via the fixing roller 188, excessive supply of the dispersion medium to the recording face of the paper 122 may be suppressed.

Particle dispersion that is not supplied to the fixing roller 188 stays retained in the web 210 and is transferred in the direction of the arrows, and is recovered. Thus, soiling of the interior of the inkjet recording device 1 by the particles may be assuredly reduced.

The first rod 212 is provided at the fixing roller 188 rotation direction downstream side relative to the ejection head 214, and touches against the surface of the fixing roller 188 with the web 210 therebetween. The second rod 216 is disposed at the fixing roller 188 rotation direction upstream side relative to the ejection head 214, at a position that does not contact the fixing roller 188. That is, the web 210 is supported from the rear face thereof by the first rod 212 and contacts the fixing roller 188, tension is applied to the web 210 by the second rod 216 that does not contact the fixing roller 188, and the web 210 makes area contact over a breadth along the circumferential direction of the fixing roller 188. The ejection head 214 is disposed so as to nip the web 210 against the fixing roller 188 between the first rod 212 and the second rod 216. Thus, the particle dispersion ejected from the ejection head 214 permeates through the web 210 and is supplied to the fixing roller 188.

Here, the particle dispersion pools (a bead of the particle dispersion is formed) in the vicinity of the web 210 that is between the ejection head 214 and the fixing roller 188 at the fixing roller 188 rotation direction upstream side relative to the first rod 212. Thus, the particle dispersion may be supplied to the fixing roller 188 consistently.

The position of the first rod 212 is varied by vibrations of the fixing drum (impression cylinder) 184, and it is preferable for the first rod 212 to be pressed against the fixing roller 188 by a pressure spring, with a view to suppressing inconsistency of the bead of the particle dispersion between the first rod 212 and the fixing roller 188 and maintaining supply consistency. Hence, variations in the position of the first rod 212 with respect to the fixing roller 188 may be kept to a minimum. In addition, the first rod 212 is prevented from contacting the fixing roller 188 with excessive pressure, abrasion of the fixing roller 188 is reduced, and an effect of the lifespan of the fixing roller 188 being increased may be expected.

Because the second rod 216 is disposed so as not to contact the fixing roller 188, pooling of the particle dispersion at the fixing roller 188 rotation direction upstream side relative to the second rod 216 may be inhibited and occurrences of dripping suppressed. Moreover, removal by the second rod 216 of particle dispersion that has momentarily adhered to the fixing roller 188 when the web 210 moves in the direction of the arrows may be suppressed. A separation amount between the second rod 216 and the fixing roller 188 is preferably wider than the thickness of the web 210.

The contact surface of the web 210 between the ejection head 214 and the fixing roller 188 is renewed by the web 210 being taken up by the winding roller 218. Therefore, clogging of the particles of the particle dispersion in the web 210 may be avoided and constant amounts of the particle dispersion may be supplied to the fixing roller 188.

It is preferable if the movement direction of the web 210 and the rotation direction of the fixing roller 188 are in opposite directions. Hence, an effect of the particle dispersion (particularly the particles) being wiped from the web 210 by the fixing roller 188 is provided. However, if the movement direction of the web 210 and the rotation direction of the fixing roller 188 may be in the same direction, there is no problem.

The particle dispersion supplied to the fixing roller 188 is coated (transferred) onto the paper 122 on the fixing drum 184. The particle dispersion is more easily transferred from the fixing roller 188 at image portions of the paper 122, because of viscosity of an ink layer, while the particle dispersion is less likely to be transferred from the fixing roller 188 at non-image portions of the paper 122. Therefore, the particle dispersion is selectively applied to image portions of the paper 122.

It is preferable if the supply unit 202 is contacted with and separated from the fixing roller 188 at arbitrary timings. An arbitrary contacting timing is, for example, just after printing begins, and an arbitrary separation timing is, for example, just after printing ends or when printing is stopped. The abutting and separation of the supply unit 202 may be realized by, for example, a gear or a cam.

Figure 3:
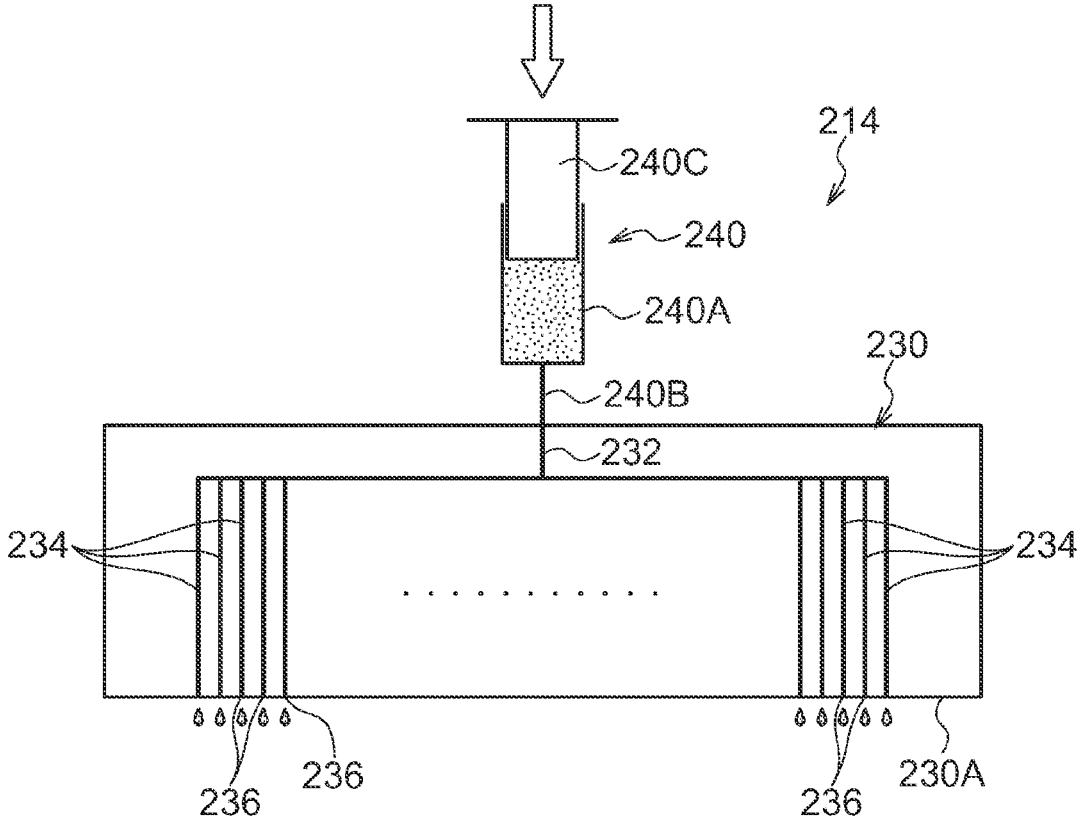
FIG. 3 is a schematic structural diagram illustrating an ejection device that is used at the particle dispersion supply apparatus illustrated in FIG. 2.

FIG. 3 shows a schematic conceptual diagram of the ejection head 214. As illustrated in FIG. 3, in the ejection head 214, a syringe 240 for ejection driving is disposed at the opposite side of a head main body 230 from the side thereof at which the ejection face 230A is provided. The syringe 240 is provided with a cylindrical portion 240A charged with the particle dispersion, a flow tube 240B attached to a distal end of the cylindrical portion 240A, and a pushing body 240C that is inserted into the cylindrical portion 240A and pushes the particle dispersion charged into the cylindrical portion 240A toward the flow tube 240B. At the syringe 240, the particle dispersion charged into the cylindrical portion 240A is introduced into the flow tube 240B by the pushing body 240C being pushed in the arrowed direction. An unillustrated supply port is provided at a side face of the cylindrical portion 240A, and the particle dispersion is charged through the supply port.

The flow tube 240B is connected to a single flow pipe 232 provided at the head main body 230. The head main body 230 is provided with plural flow pipes 234 branching from the flow pipe 232, and plural nozzle holes 236 formed in the ejection face 230A at distal ends of the flow pipes 234. The plural nozzle holes 236 are arrayed along the axial direction of the fixing roller 188. Alternatively, the plural nozzle holes 236 may be arranged in a plural number of rows along the axial direction of the fixing roller 188.

In this ejection head 214, the particle dispersion that is introduced into the flow tube 240B by pushing of the pushing body 240C passes through the plural flow pipes 234 branching from the single flow pipe 232 and is ejected from the plural nozzle holes 236. Because the particle dispersion is ejected from the plural nozzle holes 236, unevenness of the particle distribution within the ejection face 230A of the ejection head 214 may be suppressed.

In the particle dispersion supply apparatus 200, the liquid alone, not containing the particles, may be ejected at the fixing roller 188 either before ejection or after ejection of the particle dispersion by the ejection head 214, meaning before or after use of the device. When this is done, the liquid not containing the particles may be ejected from the ejection head 214 by separate driving, a structure may be used in which a cleaning ejection head (not illustrated) that ejects the liquid not containing the particles is provided and the ejection head 214 and the cleaning ejection head are selectively driven to eject, or the like. If the liquid not containing the particles is ejected at the fixing roller 188 alone before ejection or after ejection of the particle dispersion by the ejection head 214, clogging of the ejection head 214 and the web 210 is suppressed and particles may be removed from the ejection head 214 and the web 210.

A surface material of the fixing roller 188 preferably has a small surface energy, and it is preferable if the surface energy is, for example, 40 mN/m or less. When the surface energy of the fixing roller 188 is 40 mN/m or less, it is easy to transfer the particle dispersion from the fixing roller 188 to the recording face of the paper 122, and transfer efficiency may be improved. Moreover, excessive supply of the particle dispersion from the web 210 to the fixing roller 188 may be suppressed.

It is preferable if the fixing roller 188 is spaced apart from regions of the fixing drum 184 other than the paper 122, such that the particle dispersion does not soil the fixing drum 184.

A cleaning mechanism may be provided at a region of the fixing roller 188 or the fixing drum 184 other than the touching portion of the fixing roller 188, in order to inhibit excess particle dispersion from staying adhered to and soiling the fixing roller 188 and the paper 122. For example, cleaning by scraping, wiping or the like with a blade, a wiper or the like is preferable. By waste paper being used as cleaning paper and passed through the interior of the inkjet recording device 1, soiling may be caused to adhere thereto and removed.

A degree of closeness of contact between the particle dispersion and the recording face of the paper 122 may be adjusted by the following measures.

(1) Viscosity of the ink layer may be controlled; for example, drying conditions of the ink layer may be varied and the viscosity controlled by the control of the drying conditions.

(2) A nipping pressure of fixing by the fixing roller 188 may be increased. Further, depending on the case, a pressure roller may be provided separately from the fixing roller 188, the particles embedded in the ink layer by two stages of pressing, and the degree of closeness of contact thus increased.

(3) Because the numbers of particles that are required differ with different kinds of paper and ink application amounts, feeding amounts may be made adjustable in accordance with paper types and ink amounts.

(4) Printed matter (the paper 122) that is closer to the start of a job (a number of sheets of paper to be printed) is disposed closer to the bottom of a stack. Therefore, stacker blocking tends to be more serious due to the weight from printed matter higher up in the pile. Therefore, the number of particles that are required is larger toward the start of a job. With a view to maintaining a constant number of particles in a job, amounts of the particle dispersion ejected from the ejection head 214 may be varied within a job, with initial ejection amounts being larger and final ejection amounts being smaller.

—Operation and Effects—

As illustrated in FIG. 1, the paper 122 supplied from the paper supply section 110 is conveyed along the outer periphery faces of the rotating paper supply cylinder 152 and the processing liquid drum 154. In the processing liquid application section 112, the processing liquid application apparatus 156 coats the processing liquid onto the recording face (image formation face) of the paper 122 being conveyed along the outer periphery face of the processing liquid drum 154.

Via the intermediate conveyance section 124, the paper 122 onto which the processing liquid has been coated is conveyed along the outer periphery face of the imaging drum 170. In the imaging section 114, the inkjet heads 172C, 172M, 172Y and 172K of the respective colors eject droplets (ink) at the recording face of the paper 122 being conveyed by the imaging drum 170 and form an image on the paper 122. Here, the ink comes into contact with the processing liquid that was previously coated onto the recording face at the processing liquid application section 112, the colorants or resin particles dispersed in the ink coagulate, and coagulations are formed. Thus, flowing of colorants on the paper 122 is prevented and the image is formed on the recording face of the paper 122.

Via the intermediate conveyance section 126, the paper 122 on whose recording face the image has been formed is conveyed along the outer periphery face of the drying drum 176. In the drying section 116, water included in the paper 122 being conveyed by the drying drum 176 after the ink ejection is dried by heat from the infrared heaters 178 and a hot wind blown from the hot air heater 180 (i.e., moisture contained in the solvent that has been separated by the coagulation action is reduced).

Via the intermediate conveyance section 128, the paper 122 is conveyed along the outer periphery face of the fixing drum 184. In the intermediate conveyance section 128, water included in the paper 122 after the ink ejection is dried by a hot wind blown from the hot air heater (not illustrated) at the recording face of the paper 122 (i.e., moisture contained in the solvent that has been separated by the coagulation action is reduced).

In the fixing section 118, the image that has been formed on the paper 122 is fixed to the paper 122 by pressing by the fixing drum 184 and the fixing roller 188.

The particle dispersion supply apparatus 200 is provided in the fixing section 118. As illustrated in FIG. 2, the web 210 is supported by the first rod 212 so as to contact the fixing roller 188 and tension is applied to the web 210 by the second rod 216. In this state, the web 210 is moved in the direction of the arrows by the feedout roller 208 and the winding roller 218.

In the particle dispersion supply apparatus 200, the particle dispersion (the liquid containing the numerous particles) is ejected from the ejection face 230A of the ejection head 214 (see FIG. 3), the particle dispersion is retained in the web 210, and the particle dispersion permeates through the web 210. Thus, the particle dispersion (reference numeral 250 in FIG. 2) is supplied to the fixing roller 188. The particle dispersion applied to the fixing roller 188 is coated onto the recording face of the paper 122 by the fixing roller 188 rotating in the direction of the arrow. As a result, the numerous particles are adhered to the recording face of the paper 122. Thus, the particles may be caused to adhere to the recording face of the paper 122 without flying around.

Because the web 210 is disposed between the ejection head 214 and the fixing roller 188, occurrences of dripping when the particle dispersion is ejected from the ejection head 214 may be suppressed and the particle dispersion may be supplied to the fixing roller 188 consistently.

As illustrated in FIG. 1, in the fixing section 118, the paper 122 retained at the fixing drum 184 passes through a region opposing the inline sensor 190, and a check pattern on the passing paper 122, a water amount, a surface temperature, glossiness and the like are measured.

The paper 122 that has been measured by the inline sensor 190 is conveyed by the handover cylinder 194 and the conveyance belt 196 and discharged to the discharge tray 192.

In this inkjet recording device 1, the particles may be adhered to the recording face of the paper 122 by the particle dispersion supply apparatus 200 such that the particles do not fly around, and soiling of the interior of the inkjet recording device 1 by the particles may be suppressed. Moreover, because the particles are adhered to the recording face of the paper 122, occurrences of stacker blocking when the paper 122 is stacked on the discharge tray 192 may be suppressed.

The syringe 240 for driving ejection is provided at the ejection head 214 of the particle dispersion supply apparatus 200. Thus, ejection amounts of the particle dispersion may be controlled inexpensively.

In the particle dispersion supply apparatus 200, the particle dispersion is coated onto the recording face of the paper 122 using the fixing roller 188 that is used in the inkjet recording device 1 anyway. Therefore, the number of components may be kept down and fixing performance with respect to the paper 122 may be maintained.

The particle dispersion supply apparatus 200 is disposed just following a drying process in which the recording face of the paper 122 after the ink ejection is dried by the hot air heater (not illustrated) of the intermediate conveyance section 128. Thus, embedding of the particles into the paper 122 is excellent.

—Other—

An exemplary embodiment of the present invention is described hereabove but the invention is not limited in any way by the above exemplary embodiment. It will be clear to those skilled in the art that numerous embodiments are possible within a technical scope not departing from the spirit of the present invention.

In the particle dispersion supply apparatus 200 of the present exemplary embodiment, the fixing roller 188 is used as an example of the roller, but this is not a limitation and another roller may be used. The feedout roller 208 feeding out the web 210 and winding roller 218 taking up the web 210 are also not limited to the configuration of the present exemplary embodiment and modifications thereof are possible.

In the particle dispersion supply apparatus 200 of the present exemplary embodiment, the web 210 moves in the direction of the arrows but this is not a limitation; configurations are possible in which the web 210 does not move. In such a case, it is preferable to provide a cleaning unit to suppress clogging of the web 210 by the particles. An arbitrary structure that ejects the liquid not containing the particles from the rear face side of the web 210 or the like can be used as the cleaning unit.

An inkjet-type image forming device that employs aqueous inks using water as a solvent has been given as an example in the present exemplary embodiment. However, ejected liquids are not limited to inks for image formation, text printing or the like. The invention may be applied to various ejection fluids provided they are liquids that use a solvent or dispersion medium that soaks into a recording medium.

What is claimed is:

1. A particle dispersion supply apparatus comprising:

a roller that rotates in a prescribed direction and touches an image formation face of a recording medium conveyed by a conveyance body;

an ejection device that is disposed to oppose the roller at an upstream side of a rotation direction of the roller relative to a position at which the roller touches the image formation face of the recording medium, and that ejects a particle dispersion in which numerous particles are dispersed in a liquid; and a particle dispersion permeation member that is disposed so as to be interposed between the ejection device and the roller and so as to contact the roller, that retains the particle dispersion, and through which the particle dispersion is permeated.

2. The particle dispersion supply apparatus according to claim 1, wherein the ejection device ejects the particle dispersion from numerous holes formed in an ejection face.

3. The particle dispersion supply apparatus according to claim 1, wherein a syringe is used for ejection driving of the ejection device.

4. The particle dispersion supply apparatus according to claim 1, wherein, one of before ejection and after ejection of the particle dispersion by the ejection device, liquid that does not contain the particles is ejected at the particle dispersion permeation member from at least one of the ejection device or a cleaning ejection device.

5. The particle dispersion supply apparatus according to claim 1, further comprising:

a pair of roll members on which respective end portions of the particle dispersion permeation member are wound;

a first support member that is disposed at a downstream side of the rotation direction of the roller relative to the ejection device and that supports the particle dispersion permeation member from a rear face side such that the particle dispersion permeation member contacts the roller; and a second support member that is disposed at the upstream side of the rotation direction of the roller relative to the ejection device, at a position not contacting the roller, and that supports the particle dispersion permeation member and applies tension to the particle dispersion permeation member.

6. The particle dispersion supply apparatus according to claim 5, further comprising a driving section that rotates the roll members to feed out the particle dispersion permeation member.

7. The particle dispersion supply apparatus according to claim 1, wherein the liquid includes silicone oil and the particles include plastic particles with a particle diameter in a range from 10 to 50 μm.

8. The particle dispersion supply apparatus according to claim 1, wherein a void pore diameter of the particle dispersion permeation member is in a range from 1 to 10 times a particle diameter of the particles.

9. The particle dispersion supply apparatus according to claim 1, wherein the roller includes a surface material with a surface energy of 40 mN/m or less.

10. An image forming device comprising:

a droplet ejection apparatus that ejects droplets at a recording medium and forms an image;

a conveyance body that conveys the recording medium; and the particle dispersion supply apparatus according to claim 1, and the roller being a heating roller that, after droplet ejection by the droplet ejection apparatus, heats the recording medium and fixes the droplets.

11. The image forming device according to claim 10, wherein the particle dispersion supply apparatus is disposed at a position just following a drying process that dries the recording medium after the droplet ejection by the droplet ejection apparatus.

* * * * *